United States Patent [19]

Larson et al.

[11] Patent Number: 4,612,067

[45] Date of Patent: Sep. 16, 1986

[54] MANGANESE STEEL

[75] Inventors: Hugo R. Larson, Mahwah; Dilip K. Subramanyam, Pompton Lakes, both of N.J.

[73] Assignee: Abex Corporation, Stamford, Conn.

[21] Appl. No.: 736,307

[22] Filed: May 21, 1985

[51] Int. Cl.[4] ..... C22C 38/04

[52] U.S. Cl. ..... 148/329; 148/137; 420/72

[58] Field of Search ..... 75/123 N, 128 A; 148/35, 137, 31

[56] References Cited

U.S. PATENT DOCUMENTS

| | | | |
|---|---|---|---|
| 4,240,827 | 12/1980 | Aihara et al. | 75/123 N |
| 4,394,168 | 7/1983 | Hartvig et al. | 75/128 A |

FOREIGN PATENT DOCUMENTS

| | | | |
|---|---|---|---|
| 0043808 | 1/1982 | European Pat. Off. | 75/123 N |
| 53-6219 | 1/1978 | Japan | 75/123 N |
| 57-185958 | 11/1982 | Japan | 75/123 N |
| 199651 | 9/1967 | U.S.S.R. | 75/123 N |

*Primary Examiner*—Melvyn J. Andrews
*Assistant Examiner*—Deborah Yee
*Attorney, Agent, or Firm*—Kinzer, Plyer, Dorn & McEachran

[57] ABSTRACT

Austenitic (Hadfield) manganese steel containing about 25% manganese, 1.4% carbon and 0.1 to 1% silicon, balance essentially iron.

2 Claims, No Drawings

MANGANESE STEEL

BACKGROUND OF THE INVENTION

This invention relates to austenitic manganese steel. This steel is also known as Hadfield Manganese Steel, named for the inventor Robert Hadfield, British Pat. No. 200 of 1883. In this patent, the upper limit for manganese was set at 20%; in subsequent studies published in 1886, the upper limit was extended to 21%. Hadfield also discovered the toughening process ("austenitizing") by which the properties of the steel, as cast, could be improved, producing exceptional toughness and work-hardening properties, by heating the casting up to 1050° before quenching: British Pat. Nos. 11833 of 1896 and 5604 of 1902. As to the foregoing, see the Introduction in MANGANESE STEEL published 1956 by Oliver and Boyd, Edinburgh and London.

The author of "Austenitic Manganese Steel" (METALS HANDBOOKS, 8th Edition, 1961) states acceptable properties for this steel may be produced up to at least 20%. We are colleagues of the author, and have been for a number of years, and know that in actual practice over a period of many years he perceived and suggested no advantage in exceeding about 14% manganese, 1.2% carbon. The standard alloy, indeed, is and has been about 12% manganese, 1% carbon for a long time. A rule of thumb in the art is that the nominal or desirable carbon limit is about one-tenth the manganese content in percent by weight.

One major advantage of the steel is its ability to withstand wear because of its inherent work-hardening character. For this reason castings subjected to constant abuse such as liners and mantles for gyratory crushers, railroad crossings, teeth for dipper and dredge buckets, wear plates and the like have been composed of this steel.

We are also aware of U.S. Pat. Nos. 4,130,418 and 4,394,168 which address Hadfield steels of high manganese, high carbon content, which will be discussed below.

OBJECTIVES OF THE INVENTION

The primary object of the invention is to improve certain properties of austenitic manganese steel, and especially those identified with increased wear resistance. A related object is to prolong the life of austenitic manganese steel castings subjected to severe abuse in the field of utility.

Specifically it is an object of the invention to enable more carbon to be incorporated in the alloy to enhance certain properties which are associated with improved wear resistance and to achieve this by dissolving the higher amount entirely in austenite thereby avoiding the possibility of forming embrittling iron carbides at the grain boundaries. In other words, an object of the invention is to be able to incorporate more carbon in the alloy to improve wear resistance and to do this without risking formation of any consequential carbides at the grain boundaries or elsewhere in the casting. Specifically we achieve this object by resorting to a 25% to 26% (by weight) manganese content, the kinetic influence of which aids supersaturation of carbon in austenite, that is, carbon in the range of about 1.4% to 1.7% with the latter amount being deemed near, if not at the upper limit of carbon content.

We were aware of a harder grade of austenitic manganese steel, harder than the standard grade (12% manganese, 1% carbon) but also that the same alloy does not perform well in the field, actually breaking up before the expected service life due to brittle failure.

The documents on this alloy (U.S. Pat. Nos. 4,130,418 and 4,394,168) postulate manganese up to 25% and carbon in the range of 1 to 2% (see U.S. Pat. No. 4,394,168) while employing carbide formers such as titanium, with or without chromium (see U.S. Pat. No. 4,130,418). The second U.S. Pat. No. (4,394,168) recognizes and addresses the embrittlement problem at higher carbon levels, recognized by us, and seeks to overcome it by employing molybdenum (itself a strong carbide former) to spherodize carbides to render the alloy more ductile. While molybdenum is capable of serving in this role, it also has the reputation of inducing incipient fusion at the grain boundaries at a temperature below that needed for adequate solution of the carbon and austenite. This would weaken the alloy.

In the U.S. patents referred to above, the highest level of manganese suggested is 23% (U.S. Pat. No. 4,130,418) and 25% according to U.S. Pat. No. 4,394,168. In the actual working examples, however, no values above 22% are given.

We reasoned that at higher levels of manganese, say 25% by weight or higher, the thermodynamic activity of carbon in austenite is lowered and the nucleation rate of carbide $(Fe,Mn)_3C$ is slower thus aiding supersaturation of carbon in the austenite phase during the water quench following heat treatment (solutionizing). The kinetic effect of the higher manganese content would tend to offset the thermodynamic effect of the higher carbon addition, that is, the greater driving force for carbide precipitation. The alloy should therefore show super resistance to gouging abrasion without addition of any strong carbide formers, such as chromium, molybdenum and titanium and indeed the highest degree of solubility would be achieved for carbon so that there should be no embrittling carbides (e.g. iron-manganese carbides) of any consequence at the grain boundaries or elsewhere in the casting. The result should be a superior alloy with no intentional addition of any carbide former. It should be noted, however, that in melting practice when using scrap steel some chromium might be present in an inconsequential amount and a small amount of aluminum deoxidizer may also be present in our alloy.

PREFERRED EMBODIMENTS OF THE INVENTION AND COMPARISONS

The following test data bear out our conclusion and establish superior work-hardening ability for our alloy when employing enough manganese (e.g. 25%) to dissolve all carbon at levels of 1.4% or higher, rather than coupling carbon to strong carbide forming elements such as chromium, molybdenum and titanium.

TABLE I

Heats of Hadfield Steel Containing High C & Mn Additions

| Heat No. | C % | Mn % | Si % | P % | S % | Cr %* | Ni %* | Al % |
|---|---|---|---|---|---|---|---|---|
| 234 | 1.68 | 24.75 | 0.5 | 0.025 | 0.011 | 0.13 | 0.23 | |
| 325 | 1.55 | 25.48 | 0.79 | 0.034 | 0.016 | 0.15 | 0.05 | 0.038 |
| 444 | 1.43 | 24.14 | 0.45 | 0.032 | 0.014 | | | 0.035 |
| 063 | 1.49 | 24.44 | 0.60 | 0.032 | 0.013 | 0.76 | | 0.029 |

*acceptable residual or tramp element from scrap steel used in melting

Test castings from these heats were subjected to the standard heat treatment of 1900° F.–2000° F. for one to two hours, depending upon section thickness. There is no novelty in the heat treatment.

It is well known in the art that the high work-hardening rates of austenitic manganese steel make it a very suitable choice in many crusher applications. Thus, specimens taken from experimental castings were tested in tension to determine work-harding rate, that is, the ratio of the increases in stress required to produce successive increments of strain. The steel with superior work hardenability will show a greater increment of stress needed to produce the same increment of strain, that is, the slope of the stress-strain curve will be steeper for the superior alloy. The results are given in Table II.

TABLE II

| Specimen No. | Work Hardening Rate (Ksi) | Average |
|---|---|---|
| 234-4A | 282 | |
| 234-4C | 292 | |
| 234-4F | 312.5 | |
| 234-4H | 286 | 293 |
| 325-4A | 320 | |
| 325-4C | 315 | |
| 325-4E | 282 | |
| 325-4G | 301 | 305 |
| 444-4C | 273 | |
| 444-4E | 277 | |
| 444-4G | 268 | 273 |
| 063-5E | 256 | |

Examination of photomicrographs of these steels shows substantially no carbides in the microstructure and certainly no such impairment of this kind at the grain boundaries. Compared to standard Hadfield Manganese Steels, these steels show greater mechanical twin densities after deformation. This results in an increased work hardening rate in the latter.

The work-hardening rates for the steels of Table I are to be compared to those in which high manganese and high carbon are coupled to strong carbide formers, intentionally added, such as chromium, molybdenum and titanium, per Tables III and IV following.

TABLE III

| Heats of Hadfield Steel (Aim 19%, Mn, 1.5% C) Containing Intentionally Added Strong Carbide Formers | | |
|---|---|---|
| Wt. % | Heat No. 338 | Heat No. 359 |
| C | 1.5 | 1.5 |
| Mn | 19 | 19 |
| P | 0.046 | 0.043 |
| S | 0.015 | 0.016 |
| Si | 0.9 | 0.6 |
| Cr | 2.8 | 2.7 |
| Ni | 0.1 | — |
| Mo | 0.1 | 0.3 |
| Ti | 0.1 | 0.1 |
| Al* | 0.054 | 0.068 |

*Always a deoxidizer in the context of this disclosure.

TABLE IV

| Specimen No. | Work Hardening Rate |
|---|---|
| 359-22D1 | 248.3 |
| 359-22D2 | 234.2 |
| 338-23D | 248.3 |

It can be readily seen from these comparisons that addition of strong carbide forming elements to a high manganese, high carbon austenitic manganese steel detracts from work hardenability and doubtless accounts for brittle failure, both reported from field experience and documented as noted above. In comparison the field (actual service) experience in testing our alloy, devoid of strong carbide forming elements, shows outstanding performance especially in gyratory crusher (liner) service.

The results are corroborated by comparing yield strength and tensile strength for extremely thick sections where high values are traditionally equated to better service life for manganese steel liners in gyratory crushers. Here (Table V) the sections were of identical thickness ($5\frac{1}{2}$) and heat-treated to the same parameters, namely, 2000° F. for two hours (after hot shakeout of the casting) with double end quench in water.

TABLE V

| Heat No. | Specimens No. | Yield Strength | Tensile Strength |
|---|---|---|---|
| 063 | 063-5A1 | 69846 | 80435 |
| | 5A2 | 66480 | 75600 |
| | Av | 68163 | 78018 |
| 359 | 359-22 | 63120 | 77400 |
| | | 62040 | 73500 |

The chemistry of heat 063 is given in Table I. The chemistry for heat 359 is given in Table III. The alloy without carbide formers exhibits superior strength and work hardening rate.

We perceive no good reason to exceed a carbon value of about 1.5 to 1.6, nor a manganese value of about 24–28, representing a (weight) two percent allowance on either side of 26%. Increasing amounts of carbon above 1.4% do result in a greater work-hardening rate (Table II) and will be dissolved by 25% manganese (e.g. heat 234, 1.7% carbon) but clearly the optimum is about 1.4 to 1.5% carbon. A satisfactory range for the present alloy is therefore (by weight %)

Manganese: 24–28
Carbon: 1.4–1.6
Silicon: 0.1 to 1 balance essentially iron except for impurities (e.g. S and P), deoxidizers (e.g. Al) and tramp elements (e.g. Cr and Ni) in scrap steel employed in melting practice and devoid of intentionally added elements to form carbides including those of chromium, molybdenum and titanium.

Thus while we have given preferred embodiments and specified optimum practice, it is to be understood that these are capable of variation and modification by those skilled in the art adopting changes and values which are equivalent in practice.

We claim:

1. Austenitic manganese steel casting solutionized by heat treatment at about 1900°–2000° F. and in weight percent consisting of Manganese: about 25
Carbon: about 1.5
Silicon: about 0.1 to 1 balance essentially iron except for small amounts of impurities, deoxidizers or tramp elements and devoid of intentionally added elements to form carbides including those of chromium, molybdenum and titanium.

2. Steel according to claim 1 in which the work-hardening rate is about 256 (Ksi) or better.

* * * * *